US007699389B2

(12) United States Patent
Robertson

(10) Patent No.: US 7,699,389 B2
(45) Date of Patent: Apr. 20, 2010

(54) POWERED FURNITURE

(75) Inventor: Dale Robertson, Gloucestershire (GB)

(73) Assignee: Roboco Design Ltd., London (GB)

( * ) Notice: Subject to any disclaimer, the term of this patent is extended or adjusted under 35 U.S.C. 154(b) by 0 days.

(21) Appl. No.: 12/338,790

(22) Filed: Dec. 18, 2008

(65) Prior Publication Data

US 2009/0096255 A1 Apr. 16, 2009

Related U.S. Application Data

(62) Division of application No. 10/577,674, filed as application No. PCT/GB2004/004340 on Oct. 13, 2004.

(30) Foreign Application Priority Data

Oct. 30, 2003 (GB) ..... 0325358.0

(51) Int. Cl.
*A47C 1/032* (2006.01)

(52) U.S. Cl. ..... 297/85 M; 297/DIG. 10

(58) Field of Classification Search ..... 297/69, 297/83–86, 330, 331, 335, 452.38, DIG. 10
See application file for complete search history.

(56) References Cited

U.S. PATENT DOCUMENTS

| | | | | |
|---|---|---|---|---|
| 3,138,402 | A | 6/1964 | Heyl, Jr. et al. | |
| 3,338,632 | A * | 8/1967 | Kleinsorge | 297/330 |
| 3,588,170 | A | 6/1971 | Knabusch et al. | |
| 4,007,960 | A | 2/1977 | Gaffney | |
| 4,077,663 | A * | 3/1978 | Cycowicz et al. | 297/83 |
| 4,386,803 | A | 6/1983 | Gilderbloom | |
| 4,637,652 | A | 1/1987 | Bergenwall | |
| 4,722,566 | A | 2/1988 | Castellini | |
| 4,852,939 | A | 8/1989 | Krauska | |
| 5,024,486 | A | 6/1991 | Auel | |
| 5,098,158 | A | 3/1992 | Palarski | |
| 5,165,753 | A | 11/1992 | Henderson | |
| 5,294,141 | A * | 3/1994 | Mentessi et al. | 280/250.1 |
| 5,312,153 | A | 5/1994 | Lin | |
| 5,320,412 | A * | 6/1994 | Eakins et al. | 297/353 |
| 5,806,920 | A | 9/1998 | Blount | |
| 5,823,621 | A * | 10/1998 | Broadhead | 297/354.13 |
| 6,557,940 | B2 | 5/2003 | Hayashi et al. | |
| 6,871,910 | B2 | 3/2005 | Hale | |
| 2002/0125751 | A1 | 9/2002 | Bullard | |

FOREIGN PATENT DOCUMENTS

| | | |
|---|---|---|
| DE | 29812763 | 7/1998 |
| EP | 0218502 | 4/1987 |

(Continued)

*Primary Examiner*—Peter R. Brown
(74) *Attorney, Agent, or Firm*—Harness, Dickey & Pierce, P.L.C.

(57) ABSTRACT

A lift-recliner chair includes a base portion, a seat portion pivotally connected to the base portion, and a back portion pivotally connected to the seat portion. The chair further includes an actuator assembly for altering the configuration of the chair including a first actuator for moving the seat portion with respect to the base portion and second actuator for moving the back portion with respect to the seat portion. The actuator assembly is substantially enclosed on an underside of the chair, the first actuator is fixed in relation to the base portion, and the second actuator is fixed in relation to the seat portion.

18 Claims, 13 Drawing Sheets

FOREIGN PATENT DOCUMENTS

| | | |
|---|---|---|
| GB | 436475 | 10/1935 |
| GB | 847170 | 9/1960 |
| GB | 1123441 | 8/1968 |
| GB | 1211832 | 11/1970 |
| GB | 2380126 | 4/2003 |
| GB | 2380399 | 4/2003 |
| GB | 2436474 | 9/2007 |
| GB | 2436749 | 10/2007 |

* cited by examiner

POWERED FURNITURE

CROSS-REFERENCE TO RELATED APPLICATION(S)

This application is a divisional of U.S. patent application Ser. No. 10/577,674, filed on Jun. 21, 2006, which is the National Stage of International Application No. PCT/GB2004/004340, filed Oct. 13, 2004. This application also claims the benefit and priority of United Kingdom Application No. 0325358.0, filed Oct. 30, 2003. The entire disclosure of each of the above applications are incorporated herein by reference in its entirety.

FIELD

This invention relates to powered furniture and in particular concerns powered recliner chairs and lift-recliner chairs.

BACKGROUND

A typical recliner chair comprises a base that sits on the floor, a seat portion that supports a generally horizontal seat cushion and a back portion that may be fixed to the seat or pivotally connected to it. Recliner chairs are also usually provided with a footrest at the front of the chair which is movable between a vertical orientation when the chair is in a generally upright configuration for sitting, and a generally horizontal orientation when the chair is reconfigured for reclining. Recliner chairs are known where the seat portion moves during the reclining operation to tilt the seat slightly downwards at the rear edge and raise the front edge of the seat. Other types of recliner seats are known where the seat is fixed with respect to the base and only the back and footrest are moved when the seat is reclined.

Various types of lift-recliner chairs have been developed, principally for the elderly and less physically able people, to provide assistance when moving out of the chair to a standing position. Typical lift recliner chairs are described in U.S. Pat. No. 4,852,939, U.S. Pat. No. 4,993,777 and U.S. Pat. No. 5,265,935 which describe various arrangements of levers, links and motors for raising the chair from a seated to a standing position.

The actuating arrangements of known recliner and lift-recliner chairs are generally mechanically complex adding significantly to the cost, weight and complexity of the chair. In addition, in known lift-recliner chairs the seat and back portion of the chair are typically lifted off of the base support structure (typically a metal frame) when the chair is raised towards the standing position creating entrapment points between the underside of the seat and the base, and in particular in between the levers and links of the actuating arrangement that are exposed between the seat and the base support structure when the chair is raised.

There is a requirement to provide a simple actuating arrangement for recliner and lift-recliner chairs which requires fewer moving components than hitherto known designs, and also an actuating arrangement that is relatively simple to construct and to integrate within the structure of a recliner or lift recliner chair.

SUMMARY

This section provides a general summary of the disclosure, and is not a comprehensive disclosure of its full scope or all of its features.

A lift-recliner chair is disclosed that includes a base portion, a seat portion pivotally connected to the base portion, and a back portion pivotally connected to the seat portion. The chair further includes an actuator assembly for altering the configuration of the chair including a first actuator for moving the seat portion with respect to the base portion and second actuator for moving the back portion with respect to the seat portion. The actuator assembly is substantially enclosed on an underside of the chair, the first actuator is fixed in relation to the base portion, and the second actuator is fixed in relation to the seat portion.

Further areas of applicability will become apparent from the description provided herein. The description and specific examples in this summary are intended for purposes of illustration only and are not intended to limit the scope of the present disclosure.

DRAWINGS

Various embodiments of the present invention will now be more particularly described, by way of example only, with reference to the accompanying drawings, in which.

DETAILED DESCRIPTION

Example embodiments will now be described more fully with reference to the accompanying drawings.

Figure 1:
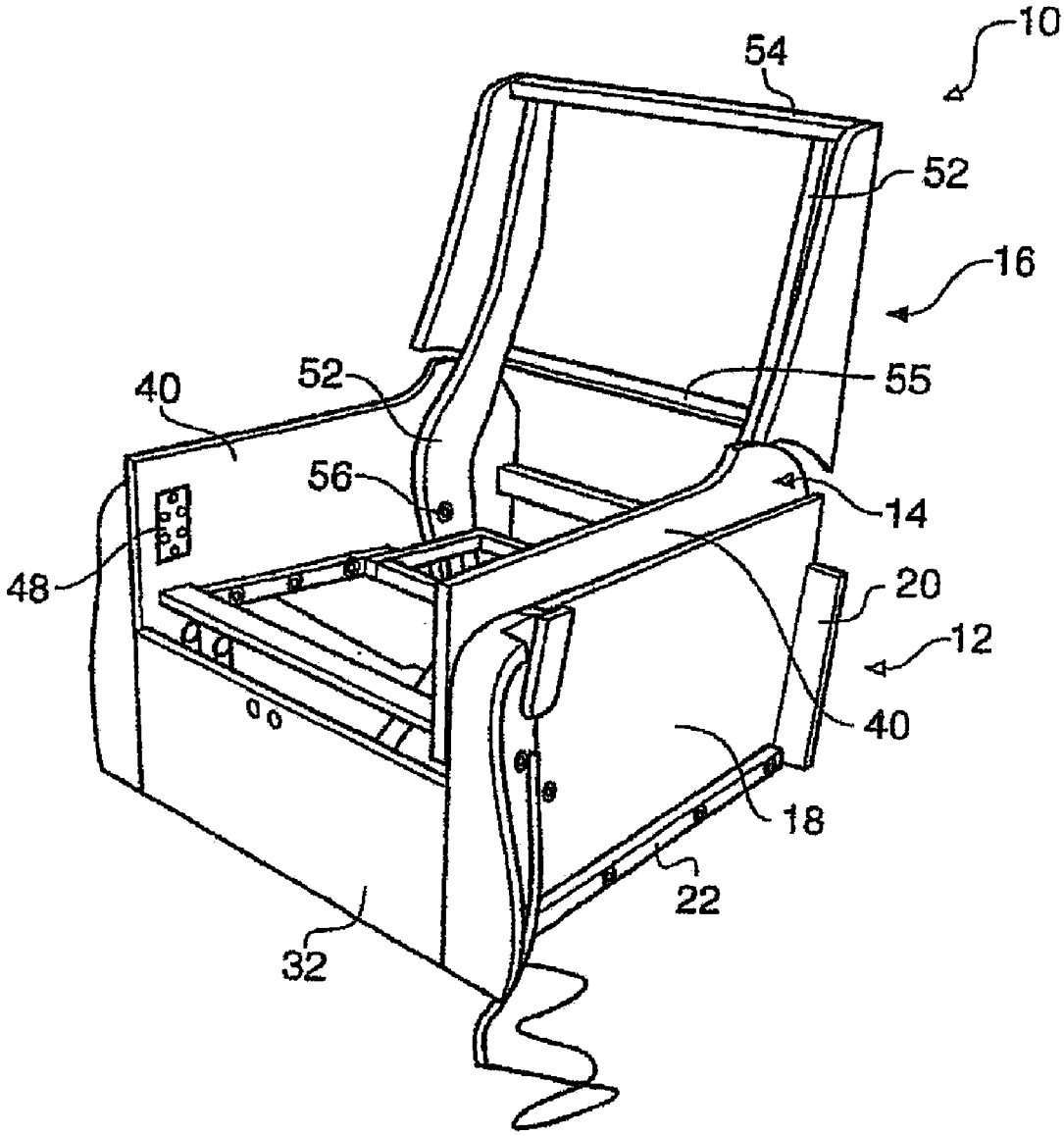
FIG. 1 is a perspective view from the front of the frame of the lift-recliner chair according to an arrangement of the present invention.

FIG. 1 shows the structural frame of a lift-recliner chair 10 according to an embodiment of the present invention. The frame, and hence the chair, comprises three main sections including a base portion 12 a seat portion 14 and a back portion 16. The base portion includes a pair of lateral side panels 18 and a rear panel 20 secured to the respective sides of the rectangular metal frame 22 on the underside of the chair. The panels 18 and 20 and the other panels of the frame of the chair shown in FIGS. 1 to 5 are preferably of MDF type hoard material but the invention also contemplates other board material such as wood, plywood or plastic etc. as is typically used in the furniture industry for upholstered and non-upholstered furniture.

Figure 2:
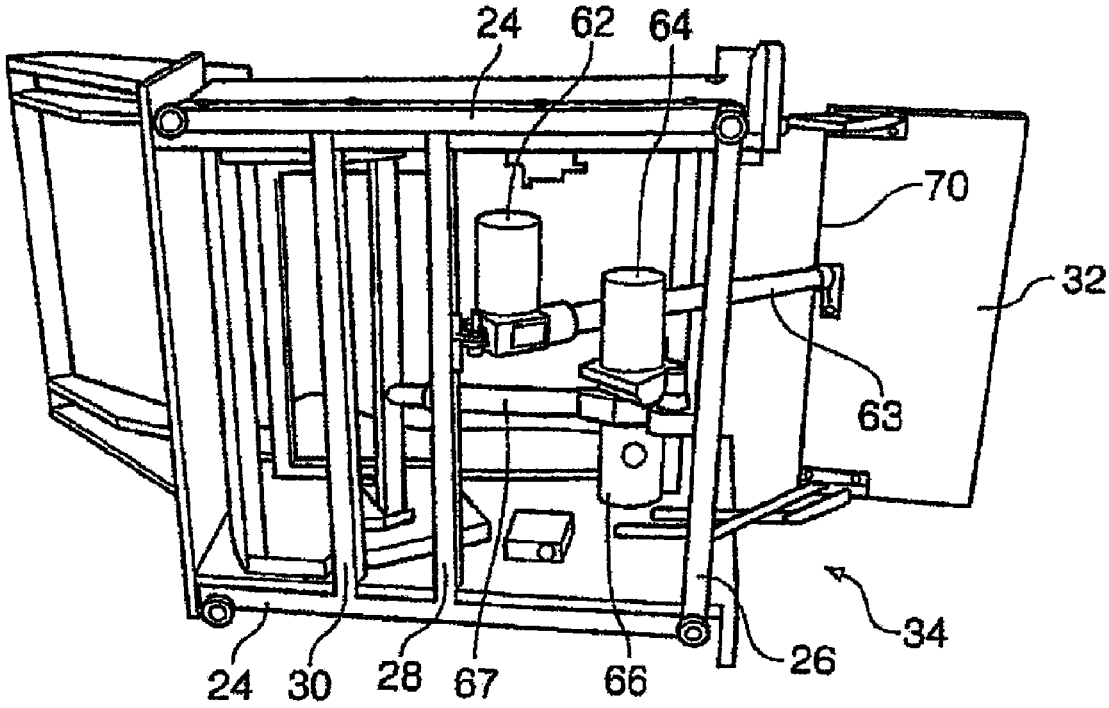
FIG. 2 is the perspective view of the frame of the chair shown FIG. 1 viewed from the underside of the chair frame.

The metal frame 22, best seen in the view of FIG. 2, comprises a pair of lateral side members 24, a front cross member 26 extending between the side members 24 at the front of the chair and a pair of intermediate cross members 28 and 30 which extend between the side members 24 at a point midway along the length of the side member and towards the rear of the chair respectively. The side panels 18 are secured to the members 24 of the frame with the rear panel 20 secured to the ends of the respective side panels at the rear of the chair to provide a box-type structure for supporting the other parts of the chair.

The base portion 12 further comprises a front panel 32 which is pivotally mounted to the lateral side panels 18 of the base by a linkage arrangement 34 at both ends of the panel 32 adjacent to the respective side panels 18. The linkage arrangement 34 is of a known arrangement and enables the front panel 32 to be moved from the position shown in FIG. 1, where it has a generally vertical orientation, to the position shown in FIG. 2, where it has a substantially horizontal configuration.

Figure 3:
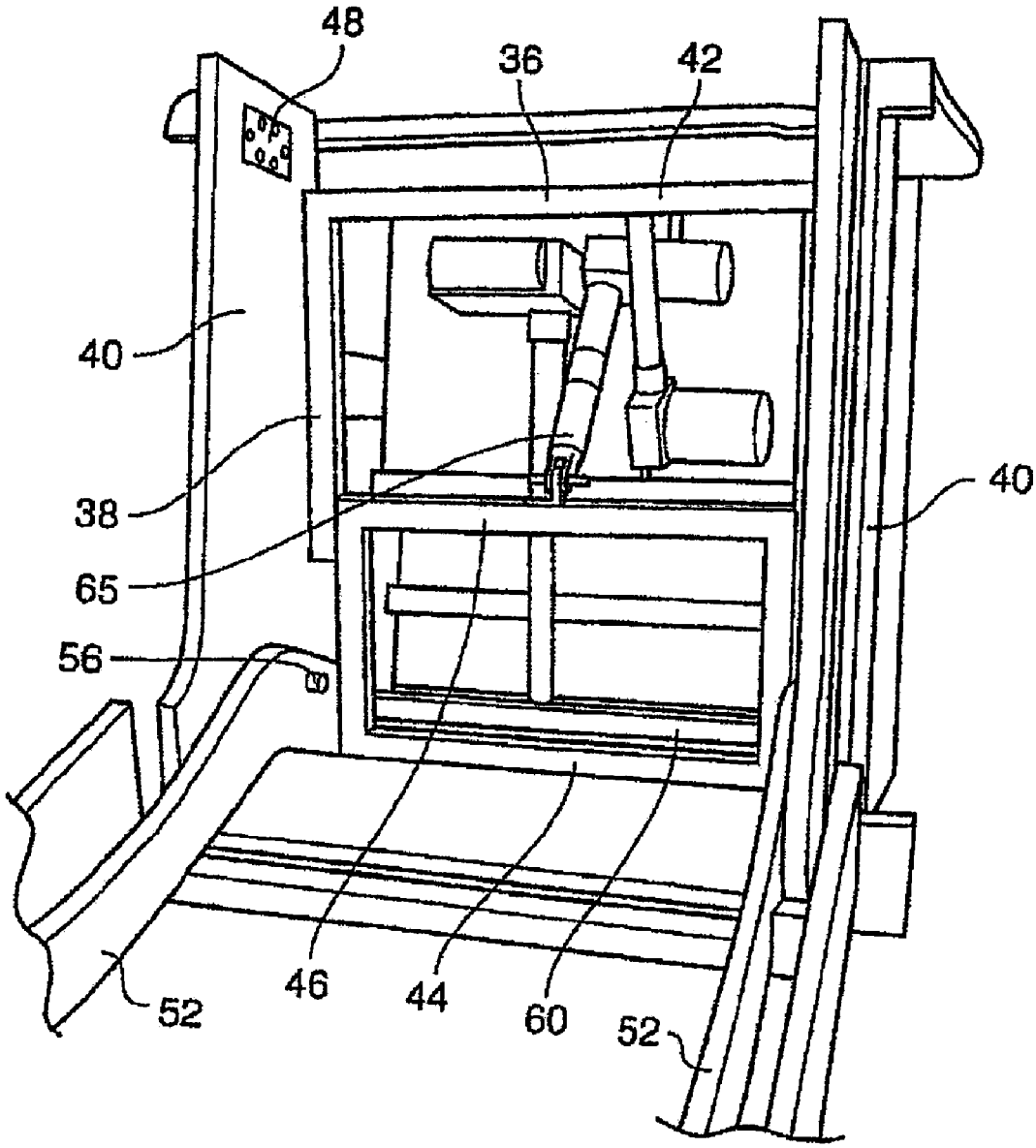
FIG. 3 is a perspective view of a chair of FIG. 1 from above.

The seat portion 14 comprises a similar box-type panel frame secured to a further metal rectangular frame 36, as can best be seen in the view of FIG. 3. The metal frame 36 includes a pair of lateral side members 38 to which the lateral side panels 40 of the seat are attached, a front cross member 42 at the front of the seat portion, a rear cross member 44 at the rear of the seat and an intermediate cross member 46 approximately midway between the front member 42 and rear member 44. The cross members extend between the side members 38. The rectangular frame section between the cross members 44 and 46 at the rear of the seat has a slightly reduced width dimension to that of the rectangular frame section between the front cross member 36 and intermediate member 46. For reasons that will become apparent later in this description this reduced width dimension provides a clearance between the side members 38 of the frame and the respective side panels 40 of the seat towards the rear of the chair. The clearance dimension is approximately equal to the width dimension of the metal tubes that constitute the metal frame.

The seat portion 14 is nested within the base portion 12 and pivotally connected to the base portion about a pivot axis perpendicular to the lateral sides 40 of the front of the chair. The seat portion is pivotally mounted to the base portion by pivot pins (not shown) which extend from pivot plates 48 through corresponding apertures in the side panels 40 and 18 towards the front of the chair.

Figure 4:
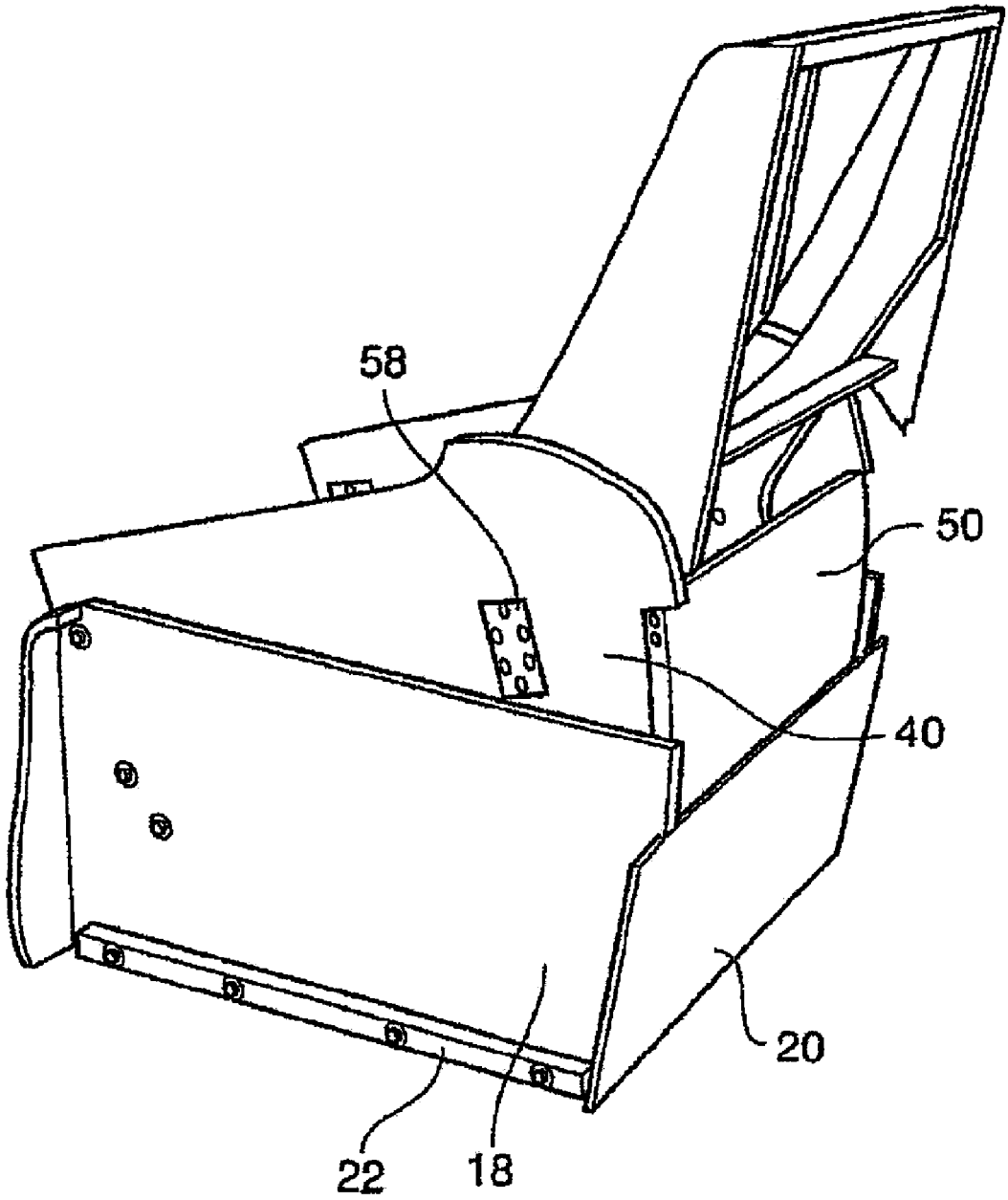
FIG. 4 is a perspective view of the frame of the chair of FIG. 1 viewed from the side showing the rear of the chair with the frame in a partly raised configuration.

The rear most ends of the side panels 40 are arcuate having a center of curvature defined by the pivot axis of the mounting pins so that the rear part of the seat portion can move freely with respect to the base end panel 20 when the seat portion is pivoted about its axis in use. Similarly, an end panel 50, as seen in FIG. 4 which extends between the side panels 40 at the rear of the chair also has a curvature which follows the curvature of the arcuate end faces 49, that is to say it has the pivot axis of the seat portion as its center of curvature.

Figure 5:
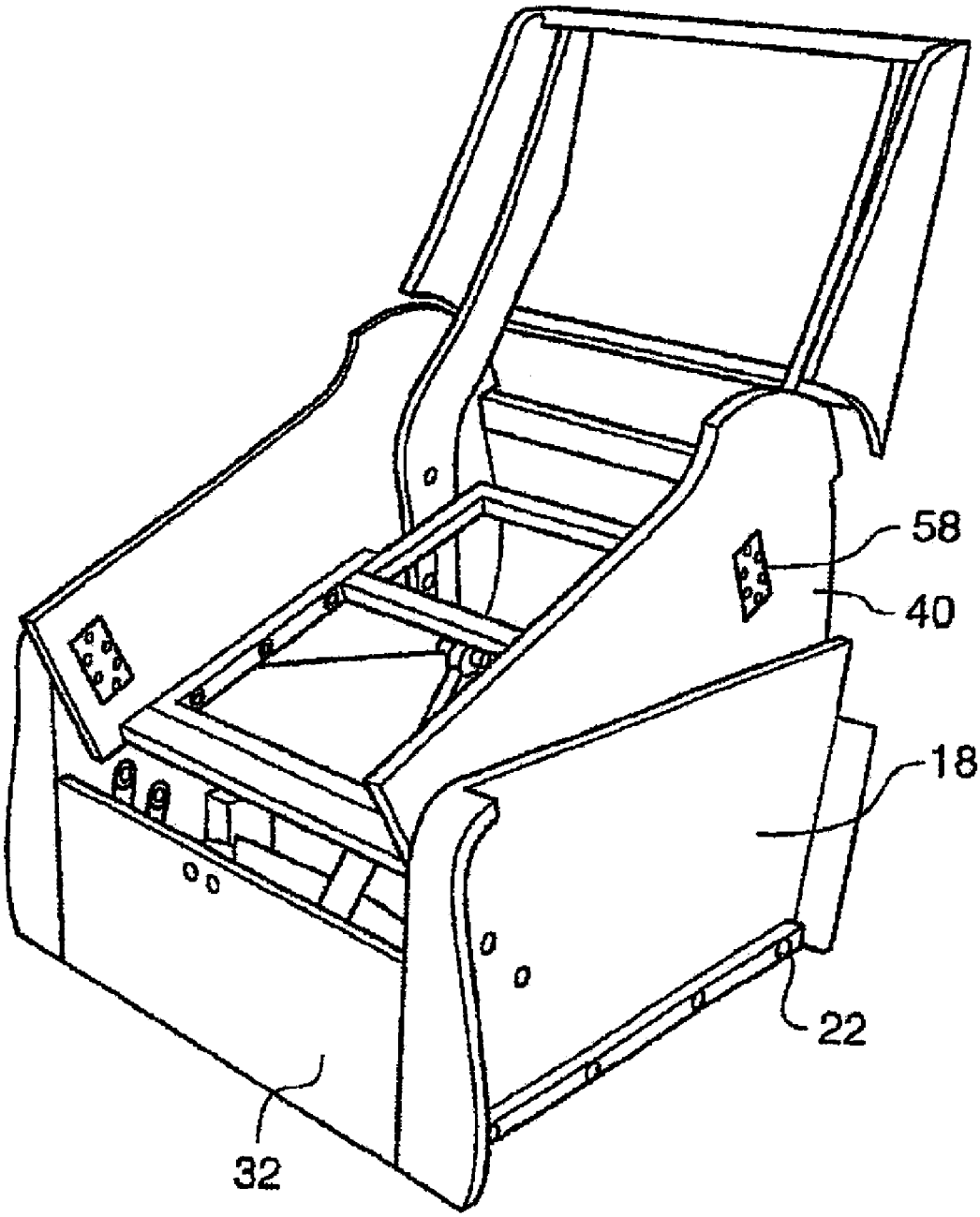
FIG. 5 is a perspective view similar to that of FIG. 1 of the frame of the chair shown in a fully raised configuration.

The width dimension of the seat portion between the side panels 40 is slightly less than the width dimension between the base side panels 18 so that the seat portion nests between the side panels 18 when in the sitting configuration shown in FIG. 1 and is extendable telescopically there from when pivoted about its pivot axis to the lift position shown in FIG. 5.

The back portion of the chair frame also comprises a rectangular frame in which a pair of elongate pivot arms 52 on the lateral sides of the back portion 16. The arms 52 are joined together by a pair of cross members 54 and 55 towards the top and the bottom part of the back portion 16. The back portion 16 is pivotally connected to the seat portion 14 in the same way that the seat portion is pivotally connected to the base 12, that is to say by means of a pair of pivot pins 56 secured to pivot pin plates 58 on the respective side panels 40. The pins 56 pass through corresponding apertures in the respective panels 40 and pivot arms 52. As can best be seen in the view of FIG. 2 the pivot arms 52 extend beyond the pivot pins 56 into the interior region of the base portion 12. The lower part of the pivot arms 52 pass through the gaps created between the undersize frame part towards the rear of the frame 36 and the side panels 40 on the seat. The ends of the pivot arms extend beyond the metal seat frame 36 into the region on the underside of the frame 36 and are joined together at their remote ends by a metal cross bar member 60.

The pivot arms 52 are free to rotate with respect to the seat portion, and hence the base portion, in a manner that enables the back portion to be reclined with respect to the seat portion either for altering the configuration of the chair from an upright configuration to a reclined configuration or to a raised configuration as shown in FIG. 5.

Three linear actuators 62, 64 and 66 are mounted on the metal frame 22 in the interior of the base portion 12 on the underside of the seat frame 36. A first of the actuators 62 is mounted on the intermediate cross member 28 with the end of the actuator ram 63 fixed to the rear face of the front panel 32 adjacent to the upper edge 70 of the front panel. Extension of the actuator arm 63 moves the front panel from its generally vertical orientation as shown in FIG. 1 to the horizontal orientation shown in FIG. 2 to provide a footrest support. Actuator 64 is mounted to the front cross member 26 of the frame 22. The actuator arm 65 of the actuator 64 is connected at its extendable end to the cross member 46 of the metal seat frame 36 so that extension of the actuator arm 65 moves seat portion 14 about its pivot access to tilt the seat portion between the positions show in FIGS. 1 and 5. The third actuator 66 is also mounted to the cross member 26 of the metal frame 22 with the extendable end of its actuator arm 67 connected to the cross member 60 extending between the pivot arms 52. Extension of the actuator arm 67 by the actuator 66 moves the back portion 16 about its pivot access to alter the tilt angle of the back portion 16 with respect to the seat portion 14. Retraction of the actuator arm 67 causes the angle between the back portion and seat portion to increase, for example when the chair is reclined or when the seat portion 14 is raised to the standing position. Extension of the actuator arm 67 reverses this operation and when fully retracted the back portion is moved to its upright position with respect to the seat portion.

Actuators, 62, 64 and 66 are of a known type, for example Dewart type 34931 linear actuators that comprise electrical motors controlled by control electronics which may in the form of a microprocessor suitably programmed to provide coordinated control of the actuators for coordinated movement of the moveable sections of the chair, both for reclining and lifting movements.

It will be understood that the configuration of the chair shown in FIGS. 1 to 5 may be changed from the upright configuration shown in FIG. 1 to a reclined configuration where the back portion 16 is reclined with respect to the remainder of the chair and the front panel 32 is raised to provide a foot rest with or without movement of the seat portion 14, and that the configuration may be changed from the upright configuration to the raised configuration shown in FIG. 5 for assisting the seated user out of the chair.

If the seat portion 14 is tilted to the raised configuration shown in FIG. 5 with the back portion 16 remaining in its upright configuration this could cause problems by dictating or even forcing an individual to move out of the chair directly from a seated position. Adjusting from a seated position to a standing position as the seat portion tilts forward may not be possible or desirable for all users. If the back portion 16 is moved to its reclined position prior to or during movement of the seat portion 16 then a user can be placed into a standing position by the chair by the time the seat portion 16 has tilted to the point at which the user leaves the chair. The chair may therefore have the facility to provide coordinated pivotal movement of the seat portion 14 and the back portion 16 in which the back portion 16 reclines as the seat portion 14 lifts. In this way an individual is moved from a seated to a standing position by the chair to avoid the possibility of them being pushed out of the chair whilst still in a seated position. In a preferred embodiment of the invention the back portion begins to tilt rearwards when the seat position is pivoted, or raised, at a point half way between its lowered and raised positions, preferably the movement of the seat and back rest portion is coordinated by control signals generated by software implemented in the microprocessor controller.

Figure 6:
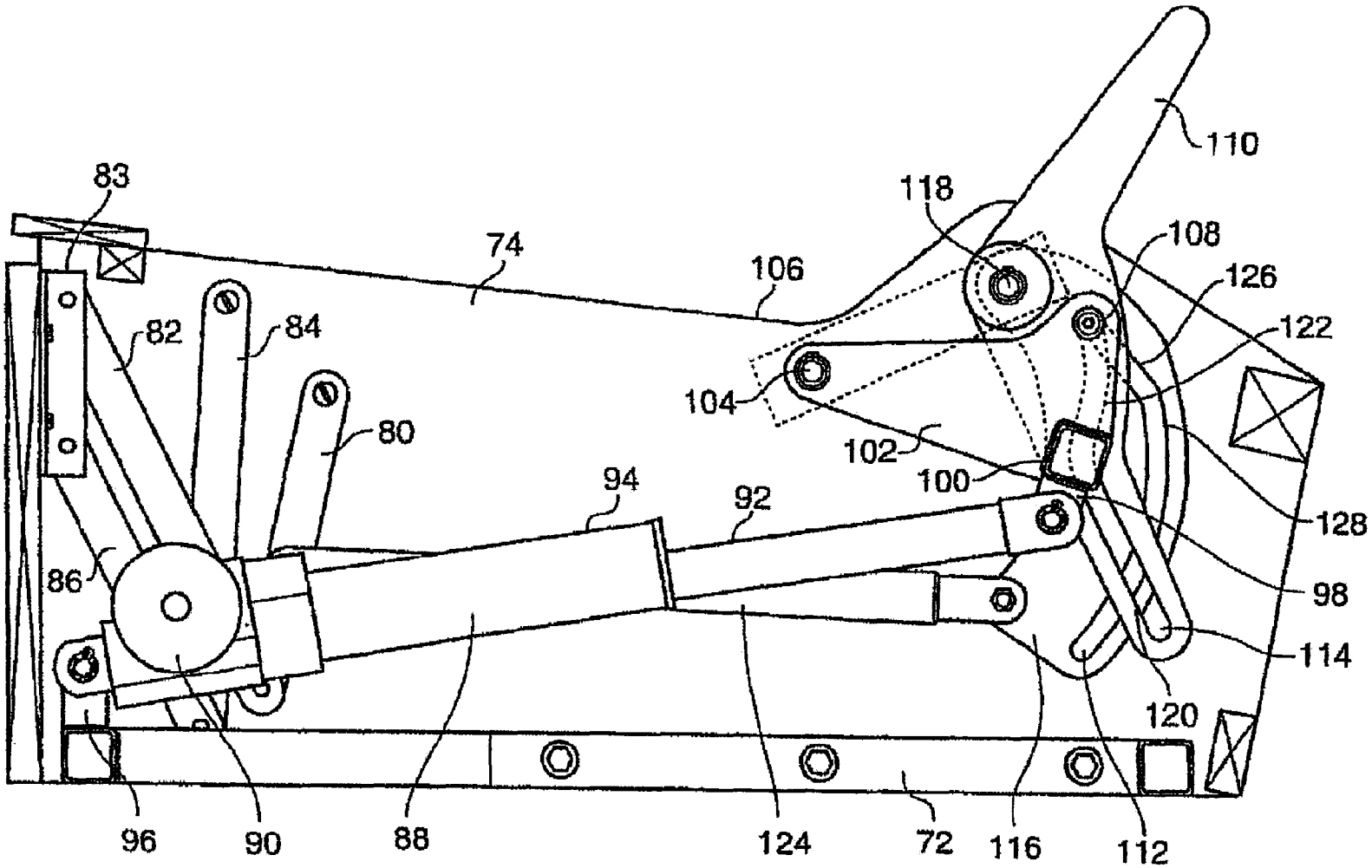
FIG. 6 is a cross-section view through the base of a lift-recliner chair according to another embodiment of the invention.

A recliner chair according to another aspect of the present invention comprises an operating mechanism as shown in the drawings of FIG. 6. FIG. 6 is a cross section view through the base portion of a recliner chair with an operating mechanism 71 housed substantially within the interior of the base of the chair. The base of the chair shown in FIG. 6 is similar to the base of the chair described with reference to FIGS. 1 to 5 in that it comprises a generally rectangular box-type structural framework including a metal base frame 72, of a tubular metal construction, and a pair of lateral side panels 74, preferably but not necessarily of MDF board material, bolted to the side members of the frame 72 on respective sides of the chair.

A front panel 76 is pivotally mounted to the side panels 74 by respective link assemblies 78 mounted on the interior side of the side panels 74 on both sides of the chair. The link assembly 78 and front panel 76 are substantially identical to the linkage system 34 and front panel 32 of the chair described with reference to FIGS. 1 to 5. The link assembly 78 on each side of the chair includes four link elements that are pivotally connected together, including a first link element 80 which is pivoted at on end to the side panel 74 and at its other end to one end of a second link element 82. The other end of the link element 82 is pivotally connected to a bracket 83 secured to the interior facing surface of the front panel 76 towards the top edge of the panel when configured in its vertical orientation as shown in FIG. 6. A third link element 84 is pivotally connected at one end thereof to the side panel 74 between the link element 80 and the front panel 76 and at the other end thereof to one end of a fourth link element 86, the other end of which is also pivotally connected to the bracket 83 at a position spaced from the link 82 and approximately one third along the depth of the front panel 76. The second and third link elements 82 and 84 are also pivotally connected together at the: point of their mutual intersection (not shown).

The front panel 76 is deployed from its vertical orientation shown in FIG. 6 to a generally horizontal orientation to provide a foot rest by activation of a linear actuator 88 located within the interior of the base of the chair. The linear actuator 88 may be a Dewart type 34931 linear actuator comprising an electric motor 90 at one end thereof and a piston arm 92 at the other end thereof which is extendable from a housing 94. The end of the actuator 88 nearest the motor section 90 is pivotally connected to a bracket 96 integral with and upstanding from the base frame 72 at the front of the frame 72. At the other end of the actuator the extendable arm 92 is pivotally connected at its end to a bracket 98 extending on one side of a square cross section metal tube member 100 to which extends along the width of the chair and is welded to respective metal bell-crank plates 102 at opposite sides of the chair, only one of which is shown in the cross-section view of FIG. 6. The bell-crank plates 102 are substantially parallel with the respective side panels 74 and perpendicular to the metal tube which connects the bell-crank plates 102 on either side of the chair together. Each bell-crank plate 102 is pivotally connected to its respective side parcel 74 by a pin type mounting 104 positioned towards the top edge 106 of the side panel 74. Each bell-crank plate 102 is provided with an upstanding engagement pin 108 extending perpendicular to the plane of the plate. The pin 108 constitutes a cam engagement means and is engaged within respective first and second cam slots 114 and 112 provided in the respective cam plates 110 and 116 pivotally mounted to the respective side panels 74 towards the rear of the chair on both sides thereof. The first and second cam plates 110 and 116 are pivotally centered on a common pivot pin 118 which extends into the interior of the base portion from the side panel 74. The cam plates 110 and 116 are generally planar and parallel with the bell-crank 102 and the side panel 74.

The first cam plate 110 constitutes a seat back cam for determining the movement path of the back portion of the chair (not show) with respect to the base. The second cam plate 116 constitutes a footrest cam for determining the movement path of the front panel 76 with respect to the side panels of the base. The seat back cam or first cam plate 110 has a shallow V-shape with the mounting pin 118 positioned at the apex of the V. The upper arm of the V, i.e., the arm shown towards the top of the drawing in FIG. 6, constitutes a lever for connecting the seat back cam plate to the back portion of the chair, while the cam slot 114 is formed in the lower arm of the V. The cam slot 114 includes a linear portion 120 and an arcuate portion 122 with the linear portion 120 extending towards the extremity of the V and the arcuate portion disposed towards the middle part of the V in the lower arm. The curvature of the arcuate portion 122 is such that the side of the slot facing the front of the chair in the view of FIG. 6 is concave.

The cam plate 116 is generally arcuate and is pivotally connected at one end of the arc to the mounting pin 118 and at its other end to a linear push rod link element 124. The cam slot 112 in the cam plate 116 also comprises a linear section 126 and a longer arcuate section 128. The arcuate section 128 of the slot extends along the majority of the arcuate length of the cam plate from the lower end of the plate that is connected to the push rod 124 along approximately 75% of the arc of the plate where the remainder of the slot is linear.

The linear push rod 124 connects the link assembly 78 to the cam plate 116. One end of the push rod 124 is pivotally connected to the first link 80 at a point substantially midway along its length, and the other end is pivotally connected to the cam plate 116.

The operating mechanism described with reference to FIG. 6 provides for simultaneous coordinated pivotal movement of the back of the chair and the foot rest front panel 76. In the drawing of FIG. 6 the operating mechanism is shown configured far a chair in an upright configuration with the front panel foot rest 16 retracted to the vertical position at the front of the chair and the back portion of the chair substantially upright with respect to the base and seat. By activating the actuator 88 to retract the arm 92 into the housing 94 the bell crank 102 is caused to rotate about the pin 104. This movement causes the cam engagement pin 108 to follow a circular path about the centre of the pin 104, in a clockwise direction when viewed in the plane of the drawn of FIG. 6. This then causes the cam plate 114 to follow the pin 108 so that the cam plate rotates about the mounting pin 118 in a clockwise direction, as viewed in the plane of the drawing of FIG. 6, thereby causing the back of the chair to rotate towards a reclined position with respect to the seat. Simultaneously, the slot 112 in the cam plate 11 is constrained to follow the movement of the cam pin 108 so that the plate 116 also rotates in a clockwise direction about the mounting pin 118. The fixed relationship between the position of the pin 118 and the end of the push rod 124 is connected to the plate 116 causes the push rod link 124 to move in general direction towards the front panel of the chair pivoting the links 80 and 84 of the link assembly also in a clockwise direction so that the front panel 76 is moved from the vertical position shown in FIG. 6 towards its deployed horizontal position to provide a foot rest.

FIGS. 7 to 13 show a lift-recliner chair 210 according to an alternative embodiment of the present invention. The chair 210 is similar to the chair 10 shown in FIGS. 1 to 5.

The chair 210 comprises a base portion 212, a seat portion 214 and a back portion 216. The seat portion 214 is pivoted with respect to the base portion 212 and is movable between the lowered position shown in FIG. 7 and the raised position shown in FIGS. 8 and 9. The back portion 216 is pivoted with respect to the seat portion 214 and is movable between the raised position shown in FIG. 7 and the reclined position shown in FIG. 10, in addition a front panel 232 is pivoted with respect to the base portion 212 and can be moved from the vertical position of FIG. 7, and best shown in FIG. 13, to the horizontal position shown in FIG. 10.

The base portion 212 includes a pair of lateral side panels 218 and a rear panel 220 is secured to the rear of the side panels 218. Together with the front panel 232 the base portion 212 comprises a box-type structure.

Figure 12:
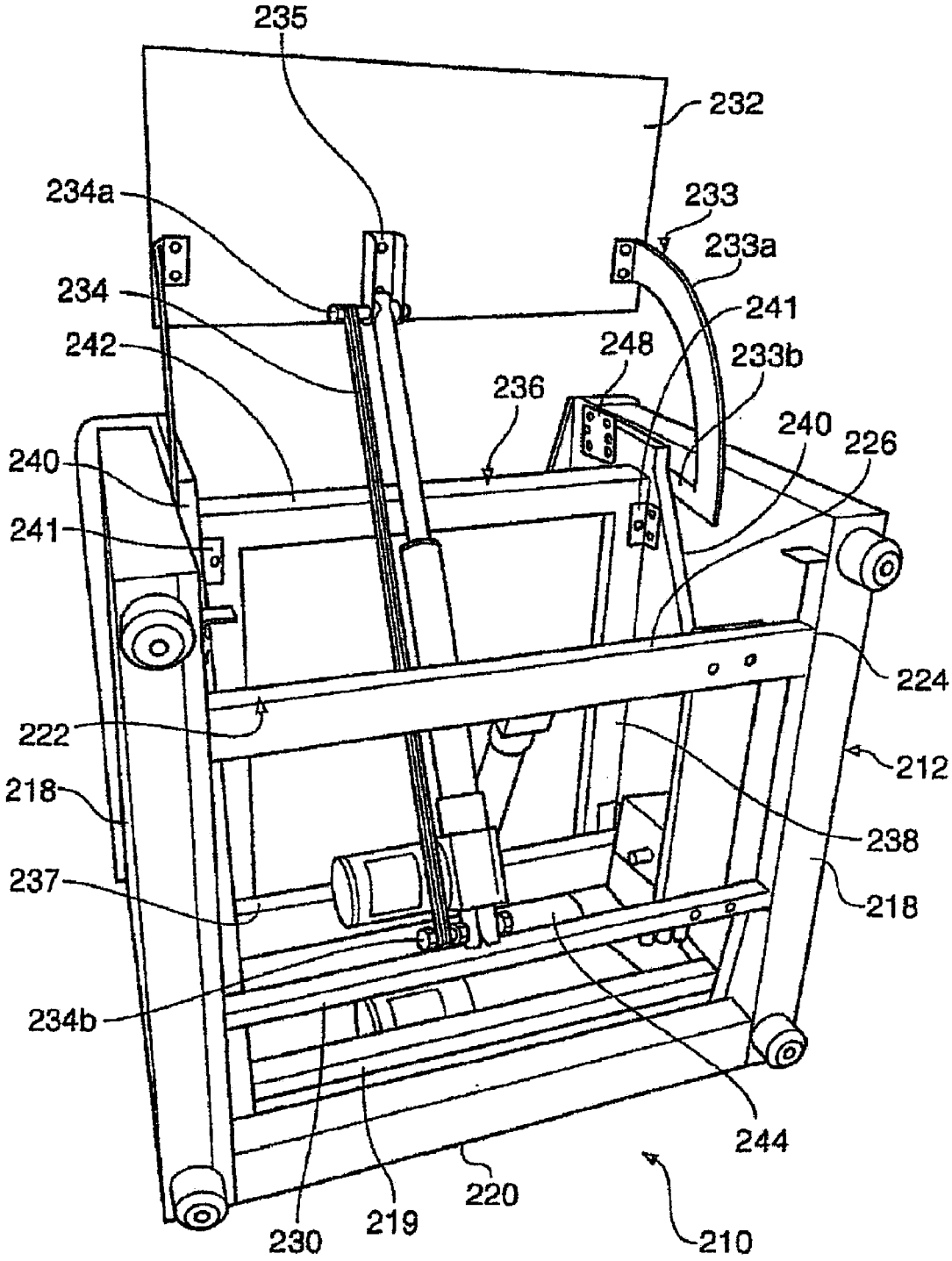
FIG. 12 is a diagrammatic perspective view showing the underneath of the chair of FIGS. 7 to 11.
Figure 13:
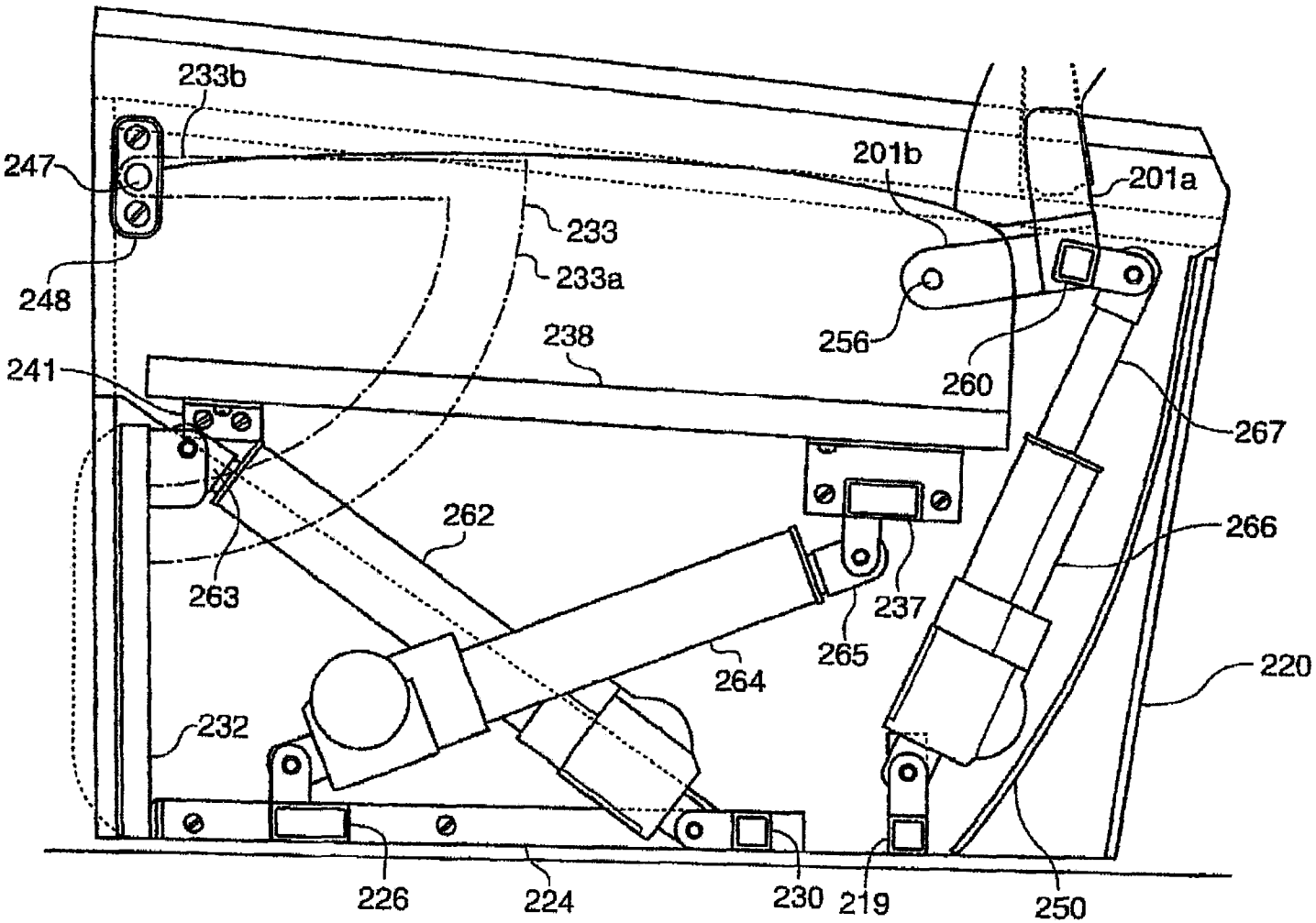
FIG. 13 is a diagrammatic side view showing the working mechanisms of the chair of FIGS. 7 to 12.

As shown in FIGS. 12 and 13 the side panels 218 are joined at their lower edges to a metal base frame 222 comprising a pair of lateral side members 224, a front cross member 226 extending between the side members 224 at the front of the chair and an intermediate cross member 230 which extends between the side members 224 towards the rear of the chair.

The seat portion 214 comprises a pair of lateral side panels 240 joined by a central, mainly wooden, rectangular frame 236. The frame 236 comprises a pair of side members 238 and front and rear cross members 242, 244 extending between the front and rear side members 238.

At the front of the seat section frame 236 the side members 238 are attached to the side panels 240 by a pair of metal reinforcement brackets 241. At the rear of the seat section frame 236 a metal cross member 237 is attached to and extends between the panels 240 and is also attached to the frame side members 238. A further cross member 219 is attached to and extends between the side panels 240 directly below the cross member 237 at the lower rear corners of the panels 240.

The seat portion 214 is nested within the base portion 212 and is pivotally connected to the base portion 212 about a pivot axis perpendicular to the side panels 240 by pivot pin 247. The pins 247 extend from pivot pin mounting plates 248 positioned at the respective upper front corners of the side panels 240 and extend through the panels 240 and through the side panels 218 of the base portion 212.

The rear ends of the side panels 240 are arcuate and an end panel 250 extending between the side panels 240 is correspondingly curved. As is the case for the chair 10 of FIGS. 1 to 5, the center of curvature of the rear ends of the side panels 240 and the end panel 250 is determined by the pivot axis 247 of the seat portion so that the seat portion 214 can extend and retract telescopically, with minimum clearance, within the base portion 212 between the lower position shown in FIG. 7 and the raised portion shown to FIGS. 8 and 9.

Figure 7:
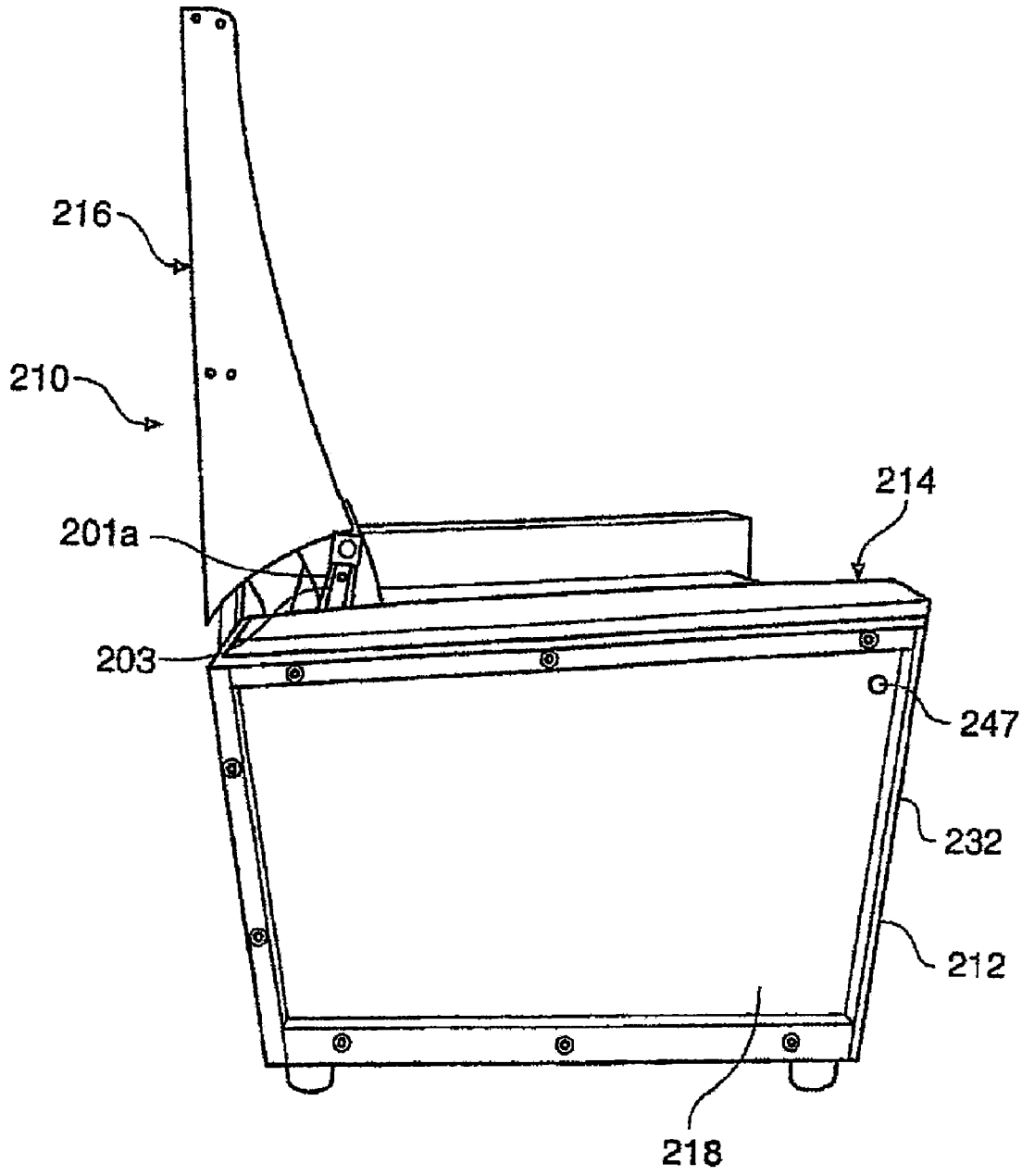
FIG. 7 is a side view of a lift-recliner chair according to a further embodiment of the invention.
Figure 8:
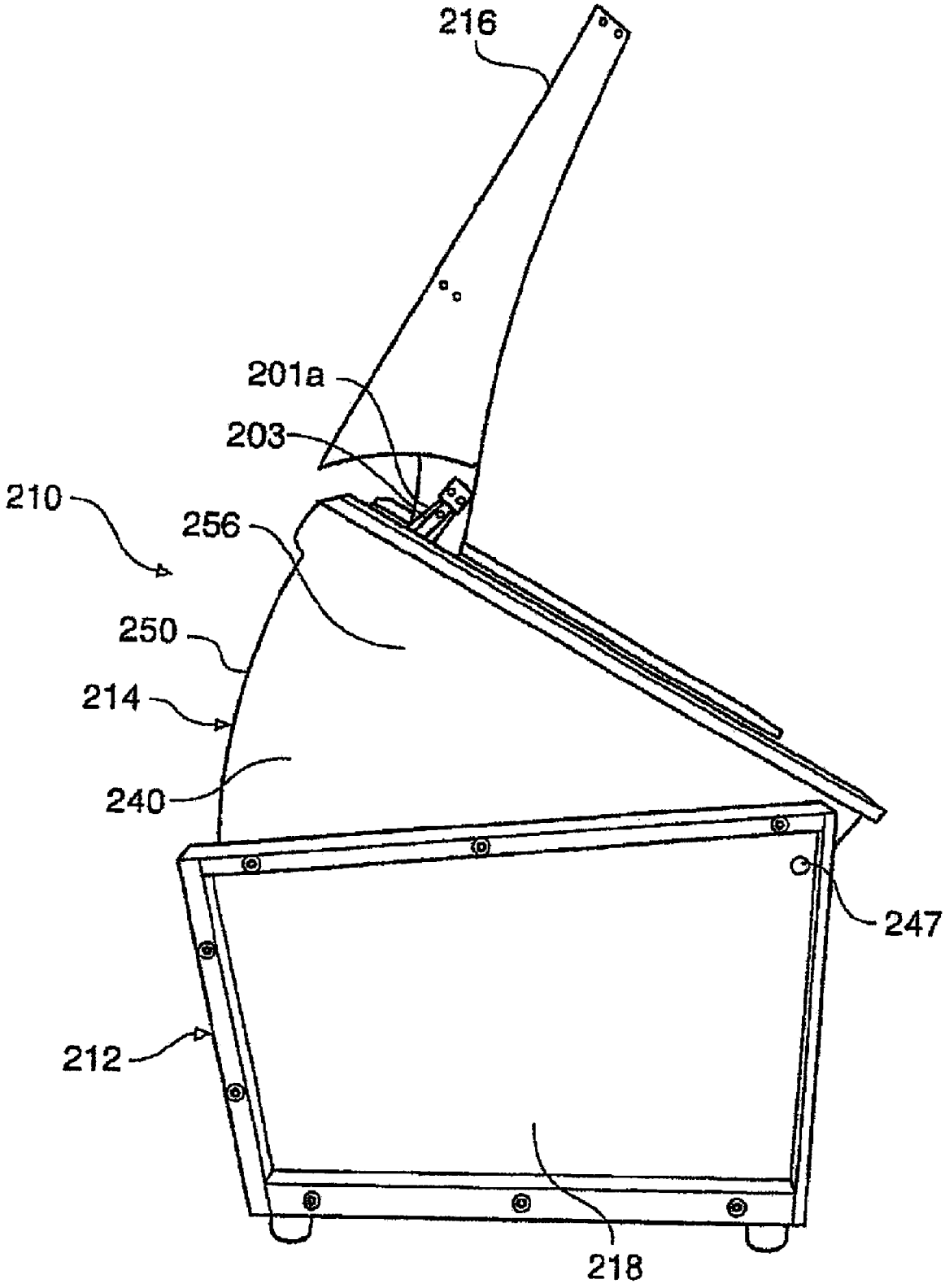
FIG. 8 is a side view of the chair of FIG. 7 shown with a seat portion in a raised configuration.
Figure 11:
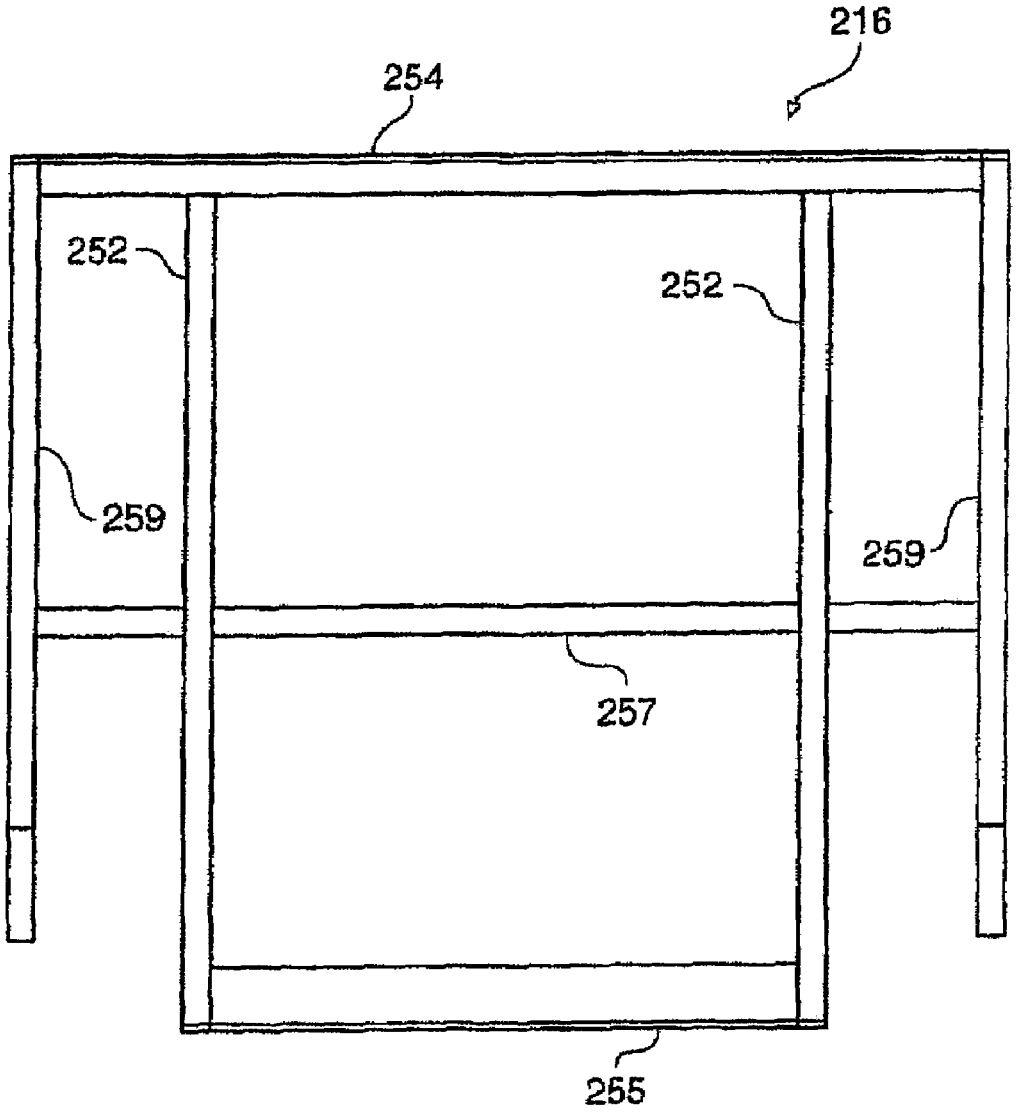
FIG. 11 is a diagrammatic view of the back section of the chair of FIGS. 7 to 10.

As shown best in FIG. 11, the back portion 216 comprises a pair of elongate pivot arms 252 joined by a top cross member 254, an intermediate cross member 257 and a bottom cross member 255. Two outer arms 259 lie outwardly spaced from and parallel to the pivot arms 252. The arms 259 are connected by the top cross member 254 and the intermediate cross member 257, and terminate slightly below the bottom of the pivot arms 252. The three cross members 254, 255, 257 aid in the attachment of webbing (not shown) in the upholstering of the chair 210. As can be seen in FIGS. 7 and 8 the pivot arms 252 are provided with metal brackets 203 for mounting the back portion 216 on corresponding interlocking bracket parts 201*a* of L-shape bell crank members 201.

A metal cross member 260 extends between and is fixed to the L-shape members 201. The pivot arms 252 thereby slot into the respective leg 201 a portions of the L-shape member 201. The other leg portions 201*b* of the L-shaped brackets 201 connect the brackets to respective pivot pins 256 extending through the panels 240. The back portion 216 is pivotally connected to the seat portion 214.

As shown best in FIGS. 12 and 13, three linear actuators 262, 264, 266 are provided within the base portion for movement of the front panel 232, the seat portion 214 and the back portion 216 respectively.

The actuator 262 is mounted centrally on the rear cross member 30 with the actuator ram 263 fixed to the rear face of the front panel 232 via a bracket 235. The actuator 263 is of the 'push only' type in which the piston is not attached to the screw jack (not shown). Accordingly the actuator 262 can move the panel 232 from the vertical position shown in FIG. 7 to the horizontal position shown in FIG. 10.

The return action is provided not by the actuator 262, but by the weight of the panel 232 and by a lightly tensioned elastic cord 234 strung between bolts 234*a*, 234*b* which extend from the points of connection of the two ends of the actuator 262 to the panel 232 and the cross member 228 respectively. Because the actuator 262 is not involved in the mount movement of the panel, if an object, such as a leg or arm, becomes trapped by the panel 232 as it moves towards the vertical position then the object is held only by the weight of the panel 232 and the tension of the cord 234. Accordingly the force applied to the object by the panel 232 is minimized and can easily be overcome compared to a system using an actuator to effect the return action.

The panel 232 is connected to the base portion 212 via two hinges 233, one at either side of the panel 232. Each hinge 233 comprises an arcuate quarter circle plate 233*a* connected at one of its circumferential ends to the panel 232 and at its other circumferential end to a linear radially extending plate 233*b*. The linear plate 233*b* is pivotally connected to the base side panels of the chair by the pivot pins 247 extending from the base portion side panels 218 through the linear plates and through the side panels 240 of the seat section to the mounting plates 248.

The main pivot point provided by pivot pins 247 thereby defines the pivot axis for both the panel 232 and the seat portion 214. This arrangement also means that the hinges 233 slide between the side panels 240 of the seat portion 214 and the side panels 218 of the base portion 212 when extended and retracted.

The positioning of the combined main pivot points of the foot rest 232 and the seat portion provided by the pivot pins 247 approximately at the upper front corners of the base portion 212 and seat portion 214, coincides with the natural position of the seated user's knee joint which brings ergonomic advantages. The same advantage could, of course, be achieved if the pivot points for the front panel and the seat portion were slightly spaced apart but still in the same general area so that they are roughly coincident with the seated user's knee joint.

Because the panel 232 is connected to the base portion 212 via hinges 233 the panel 232 can undergo only a rotation movement with no radial extension. As a result the position of the panel 232 may not extend away from the chair sufficiently to suit all users. Accordingly, in other embodiments (not shown) the chair may have some means of increasing the distance the panel extends away from the seat portion 214. For example, the panel 232 or a part thereof may be telescopic so that it moves to a position further away from the seat portion 214 during or following the pivoting movement. Alternatively a 'flipper board' arrangement could be used, in which a further panel is pivotally attached to the main foot panel 232 and can be flipped over from a position in which it rests on the panel 232 to a position in which it is co-extensive with the panel 232 to increase the length of the panel.

The actuator 264 is mounted centrally on the front cross member 226. The actuator ram 265 is fixed centrally to a cross member 237 which spans between and is attached to the side panels 240 and supports the rear of the seat section frame 236. The front of the seat section frame 236 is carried on a pair of brackets 241 attached to the frame members 238 and to the inner races of the side panels 240.

Figure 9:
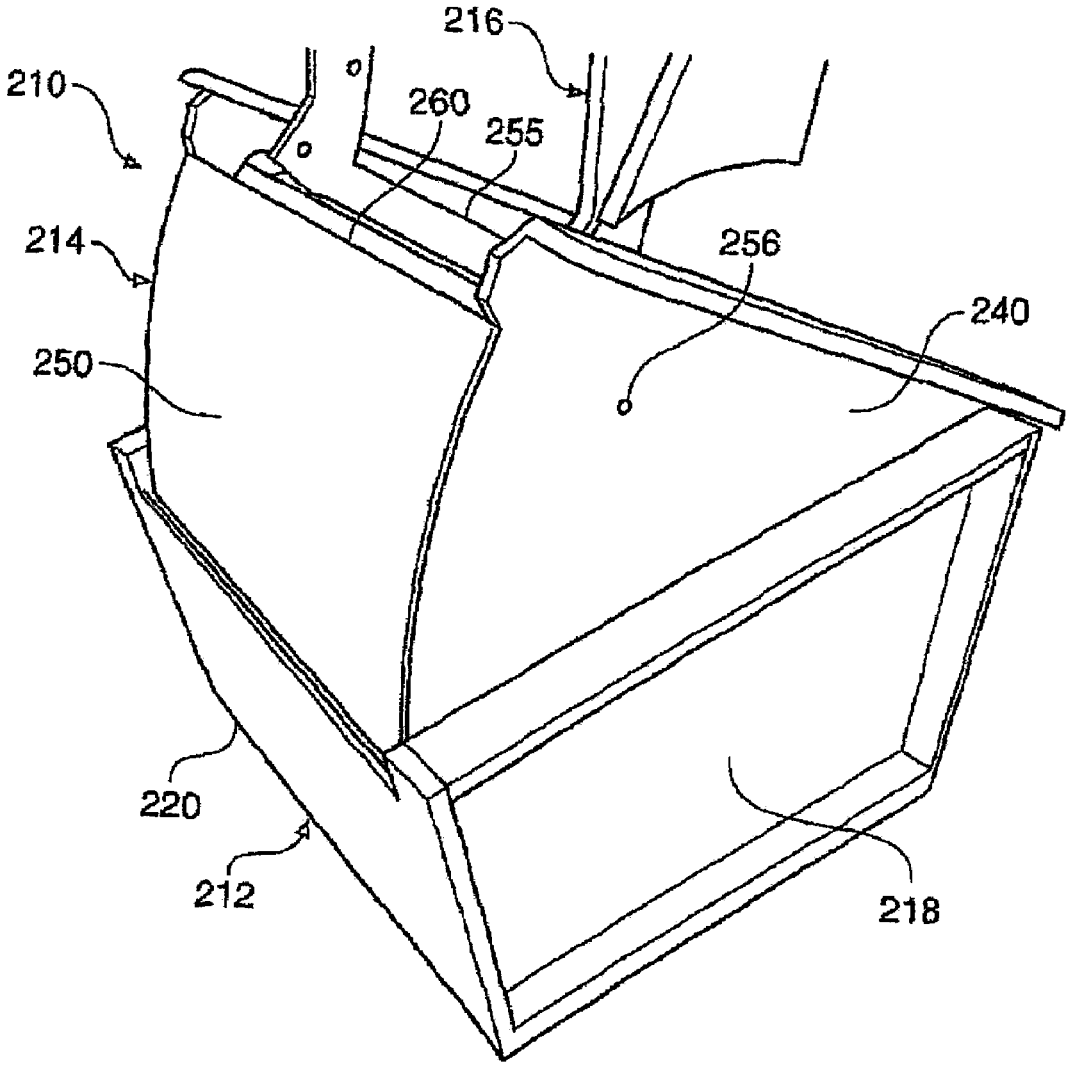
FIG. 9 is a perspective view of the rear of the chair of FIG. 8.
Figure 10:
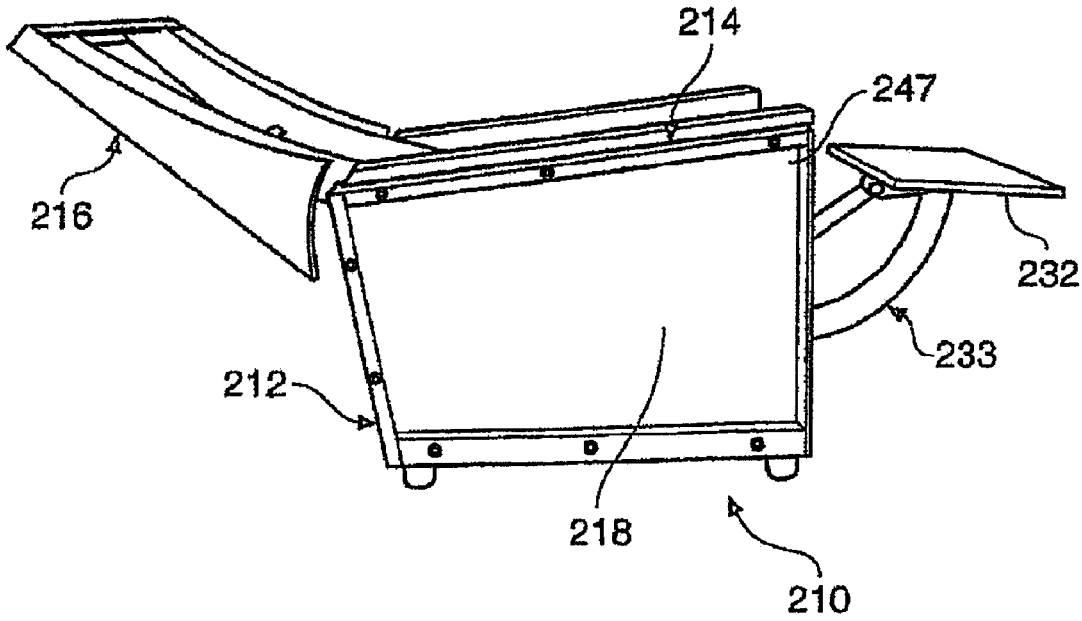
FIG. 10 is a side view of the chair of FIG. 7 shown with a back portion in a reclined configuration and a foot panel in a raised configuration.

As discussed above, the side panels 240 are pivotally connected to the main pivot points so that the seat portion 214 pivots about the pivot points under the control of the actuator 264 as shown in FIGS. 8 and 9.

The actuator 266 is mounted centrally on a cross member 219 which extends between and is fixed to the side panels 240 of the seat portion. The actuator ram 267 of actuator 266 is connected centrally to the cross member 260 at a point offset from the pivot axis 256 to provide a bell crank type lever. The bell crank arrangement means that the back portion 216 can be lowered to the position shown in FIG. 10 by retracting the ram 267, or raised to the position shown in FIG. 7 by extending the ram 267. The back portion 216 can be moved at the same time as movement of the seat portion 214 and/or the footrest panel 232 or independently thereof as previously described with reference to the embodiment of FIGS. 1 to 5.

Although aspects of the invention have been described with reference to the embodiments shown in the accompanying drawings, it is to be understood that the invention is not so limited to those precise embodiments and that various changes and modifications may be effected without further inventive skill and effort. For example, the lift recliner chair described with reference to FIGS. 1 to 5 may be modified to provide a reclining function only in the sense that the base portion of the chair is provided with only two actuators, one for reclining the back portion of the chair with respect to the base and a fixed seat, and another for deploying the front panel from its vertical position to its horizontal position to provide a foot rest for the chair. It will be appreciated that various changes and modifications may be made to the chairs described herein with any of the integers described in one embodiment being interchangeable with integers in another embodiment, and that the embodiments maybe modified by deletion or addition of any of the integers described with reference to any of the embodiments described herein.

The invention claimed is:

1. A lift-recliner chair for assisting movement of a user between a seated position and a standing position comprising:

a base portion;

a seat portion pivotally connected to the base portion;

a back portion pivotally connected to the seat portion; and an actuator assembly substantially enclosed on an underside of the chair for altering the configuration of the chair including:

a first actuator operably coupled to the base portion and the seat portion, the first actuator tilting the seat portion forward with respect to the base portion from a lowered position, in which the seat portion supports the user seated in the chair, to a fully raised position assisting movement of the user out of the chair, and a second actuator operably coupled to the seat portion and the back portion, the second actuator for moving the back portion with respect to the seat portion, the second actuator increasing an angle between the back portion and the seat portion prior to or during movement of the seat portion toward the fully raised position to facilitate movement of the user out of the chair.

2. A lift-recliner chair as claimed in claims 1 wherein the base portion comprises a pair of substantially vertical side panels and a rear panel extending between the side panels, and the seat portion comprises a seat frame including a pair of substantially vertical side panels arranged substantially parallel with and adjacent to the respective side panels of the base portion.

3. A lift-recliner chair as claimed in claim 2 wherein the seat portion is pivotally connected to the side panels of the base portion.

4. A lift-recliner chair as claimed in claim 3 wherein the seat portion is at least partially supported by the side panels of the base portion.

5. A lift-recliner chair as claimed in claim 1 wherein the seat portion is pivoted with respect to the base portion about a pivot axis positioned towards a front of the base portion.

6. A lift-recliner chair as claimed in claim 1 wherein the back portion comprises a generally rectangular frame and a pair of pivot arms which extend from the frame and pivotally connect the frame to the seat portion.

7. A lift-recliner chair as claimed its claim 6 wherein the pivot arms pivotally connect the back portion to respective side panels of the seat portion.

8. A lift-recliner chair as claimed in claim 6 wherein the pivot arms comprise part of a bell-crank for moving the back portion about a pivot axis spaced from the rectangular frame.

9. A lift-recliner chair as claimed in claim 6 wherein the pivot arms extend parallel with and adjacent to respective vertical side panels of the seat portion on an interior side thereof.

10. A lift-recliner chair as claimed in claim 1 wherein the second actuator is operatively coupled to the back portion and moves the back portion relative to the seat portion such that the back portion pivots away from the seat portion when the seat portion is raised.

11. A lift-recliner chair as claimed in claim 10 wherein the back portion pivots away from the seat portion once the seat portion is moved during lifting to a pre-determined position between the lowered position and the fully raised position.

12. A lift-recliner chair as claimed in claim 1 wherein the base portion further comprises a front panel which is pivotally mounted to respective side panels of the base portion and movable with respect to the base portion for movement from a generally vertical position to a generally horizontal position to provide a retractable foot rest.

13. A lift-recliner chair as claimed in claim 12 wherein the actuator assembly comprises a third actuator operably coupled to the side panels of the base portion for moving the front panel about a pivot axis.

14. A lift-recliner chair as claimed in claim 12 wherein the front panel is pivotally moveable with respect to the base portion about a pivot axis that extends through an area that is adjacent to an upper front corner of the side panels of the base portion.

15. A lift-recliner chair as claimed in claim 1, wherein the base portion includes a plurality of base side panels and a base cross member that extends between and is fixed at both ends to a respective one of the base side panels, wherein the seat portion includes a plurality of seat side panels and a seat cross member that extends between and is fixed at both ends to a respective one of the seat side panels, and wherein the first actuator is operably coupled to the base cross member and the second actuator is operably coupled to the seat cross member.

16. A lift-recliner chair as claimed in claim 15, wherein the base side panels and the seat side panels cooperate to enclose the first and second actuators.

17. A lift-recliner chair comprising:

a base portion;

a seat portion pivotally connected to the base portion;

a back portion pivotally connected to the seat portion; and an actuator assembly for altering the configuration of the chair including a first actuator for moving the seat portion with respect to the base portion and a second actuator for moving the back portion with respect to the seat portion, the actuator assembly being substantially enclosed on an underside of the chair, wherein the first actuator is operably coupled to the base portion and the seat portion, and wherein the second actuator is operably coupled to the seat portion and the back portion, wherein the base portion further comprises a front panel which is pivotally mounted to respective side panels of the base portion and movable with respect to the base portion for movement from a generally vertical position to a generally horizontal position to provide a retractable foot rest, wherein the front panel is pivotally moveable with respect to the base portion about a pivot axis that extends through an area that is adjacent to an upper front corner of the side panels of the base portion, wherein the pivot axis of the front panel is coincident with the pivot axis connecting the seat portion to the base portion.

18. A lift-recliner chair comprising:

a base portion;

a seat portion pivotally connected to the base portion;

a back portion pivotally connected to the seat portion; and an actuator assembly for altering the configuration of the chair including a first actuator for moving the seat portion with respect to the base portion and second actuator for moving the back portion with respect to the seat portion, the actuator assembly being substantially enclosed on an underside of the chair, wherein the first actuator is operably coupled to the base portion and the second actuator is operably coupled to the seat portion;

wherein the seat portion includes a rear panel, wherein the seat portion is pivotally connected to the base portion about a first pivot axis and pivotally connected to the back portion about a second pivot axis, and wherein the rear panel of the seat portion is curved having a center of curvature substantially coincident with the first pivot axis.

* * * * *

UNITED STATES PATENT AND TRADEMARK OFFICE

CERTIFICATE OF CORRECTION

PATENT NO. : 7,699,389 B2
APPLICATION NO. : 12/338790
DATED : August 1, 2004
INVENTOR(S) : Dale Robertson It is certified that error appears in the above-identified patent and that said Letters Patent is hereby corrected as shown below:

Title page, item (73)
Assignee "Roboco" should be -- Robco --;

Column 2, Line 27
After "shown" insert -- in -- to read -- shown in --;

Column 5, Line 44
"on" should be -- one --;

Column 6, Line 12
"parcel" should be -- panel --;

Column 6, Line 61
"far" should be -- for --;

Column 7, Line 2
"drawn" should be -- drawing --;

Column 8, Line 20
"201 a" should be -- 201a --;

Column 10, Line 21, Claim 2
"claims" should be -- claim --;

Column 10, Line 42, Claim 7
"its" should be -- in --.

Signed and Sealed this

Third Day of August, 2010

David J. Kappos

David J. Kappos
*Director of the United States Patent and Trademark Office*